United States Patent [19]

Schacht

[11] 4,229,111

[45] Oct. 21, 1980

[54] FEED MECHANISM FOR MARKING MACHINE

[76] Inventor: Roy A. Schacht, 744 Des Peres Rd., St. Louis, Mo. 63131

[21] Appl. No.: 959,785

[22] Filed: Nov. 13, 1978

[51] Int. Cl.[3] ..... B41J 11/06

[52] U.S. Cl. ..... 400/45; 400/134.1; 400/303; 400/332.4; 400/336

[58] Field of Search ..... 400/134.1, 134, 131, 400/158, 158.1, 45, 332.4, 330.8, 337, 23

[56] References Cited

U.S. PATENT DOCUMENTS

| | | | |
|---|---|---|---|
| 2,664,985 | 1/1954 | Schacht | 400/134.1 |
| 3,726,380 | 4/1973 | Beers et al. | 400/131 X |
| 3,785,470 | 1/1974 | Schacht | 400/134.1 |

*Primary Examiner*—Clifford D. Crowder
*Attorney, Agent, or Firm*—Glenn K. Robbins

[57] ABSTRACT

A marking machine for marking metal nameplates, tags or the like. The marking machine employs a work table supported on a carriage which is movable into contact with a marking wheel to perform a printing operation. Improved advancing means are provided for the work table utilizing a feed pawl link having a pair of pivot points. One pivot point is connected to a feed link while the second pivot point is connected to a drag link moveable between upper and lower stops in a carriage casting. A bottom pivot point of the drag link is provided with a friction clutch on a pivot connected otherwise to a stationary portion of the machine. An improved feed rack is further provided which is polygonal in cross-section and may have different spaced teeth on each side for selective spacing. Half-spacing adjustment means are provided whereby the feed rack may be moved axially a half-space to change the spacing on the work table. An improved carriage release is furhter provided which comprises a control member pivoted on the same pivot as the pivotable feed link and engageable with the feed link to cause the feed pawl to move both of its teeth out of engagement with the feed rack to provide for manual movement of the work table as desired.

12 Claims, 20 Drawing Figures

FEED MECHANISM FOR MARKING MACHINE

SUMMARY OF THE INVENTION

In the past various types of marking machines have been devised for physically imprinting on metal or plastic work pieces such as nameplates, tags or the like. Such marking machines have been shown by my U.S. Pat. Nos. 3,785,470; 3,263,789; 3,236,352 and 2,664,985. Marking machines utilizing rotary imprinting wheels in which the characters appear on the periphery of the wheel and are caused to print against a work piece raised into printing relationship by a vertically reciprocal work table are shown in my U.S. Pat. Nos. 2,664,985 and 3,785,470. The continuously rotating marking or printing wheel is stopped in the printing operation by the engagement of an electromagnetically operated pawl against a ratchet wheel keyed to the shaft of the printing wheel.

By means of this invention there has been provided an improved actuating means for moving the work table or advancing it in relation to the supporting carriage and marking wheel to provide for spacing after the marking operations. The improvement provides an actuating means using a pivotable pawl having a pair of teeth which engage corresponding teeth on a feed rack or feed bar. Actuating means comprising a pawl link pivotally connected to one end of the feed pawl and a drag link pivotally connected to another end of the feed pawl. In order to accommodate raising and lowering of the work table while in the operation a guide slot is provided to limit the pivotal movement connection of the feed pawl with the drag link to an upper and lower position. The drag link is further provided with a friction clutch connection to a stationary portion of the machine to accommodate the raising and lowering the work table and also to accommodate different thicknesses of work piece whether they be a nameplate, tag or the like of metal, plastic and other materials of construction. The feed advancing mechanism for the work table not only ensures proper movement of the work table for each operation but also accommodates the raising and lowering of the work table and the use of work pieces such as nameplates, tags of slightly varying thickness.

The marking machine of this invention is further provided with means for half-spacing the work table in relation to the normal spacing between the teeth of the feed rack. This is accomplished by the use of adjusting means whereby the feed rack can be moved axially with respect to the work table one-half tooth space. Further means are provided by the use of the polygonal shaped feed rack whereby spacing of the marking characters can be varied by the use of teeth on the different sides having a different spacing. Each side may be provided with adjustment means for the half-tooth spacing so that half-tooth spacing may be selected regardless of the normal spacing selected.

The marking machine of this invention is further provided with an efficient and simplified carriage release mechanism. This carriage release mechanism is pivoted on the same pivot as the feed pawl link and is provided with a contact means normally out of operation with the feed pawl link which is designed to operate and move the feed pawl link to disengage both teeth of the feed pawl from the feed rack. The work table after disengagement of both teeth of the feed pawl may then be moved manually to any desired position.

The feed pawl advancing mechanism and half-tooth spacing and carriage release are all designed for simple operation of the marking machine with the raising and lowering of the work table. The machine is rugged in operation and can be simply operated and maintained by relatively unskilled workmen.

The above features are objects of this invention and further objects will appear in the detailed description which follows and will be otherwise apparent to those skilled in the art.

For the purpose of illustration of this invention there is shown in the accompanying drawings a preferred embodiment thereof. It is to be understood that these drawings are for the purpose of example only and that the invention is not limited thereto.

In the drawings

DESCRIPTION OF THE INVENTION

Figure 2:
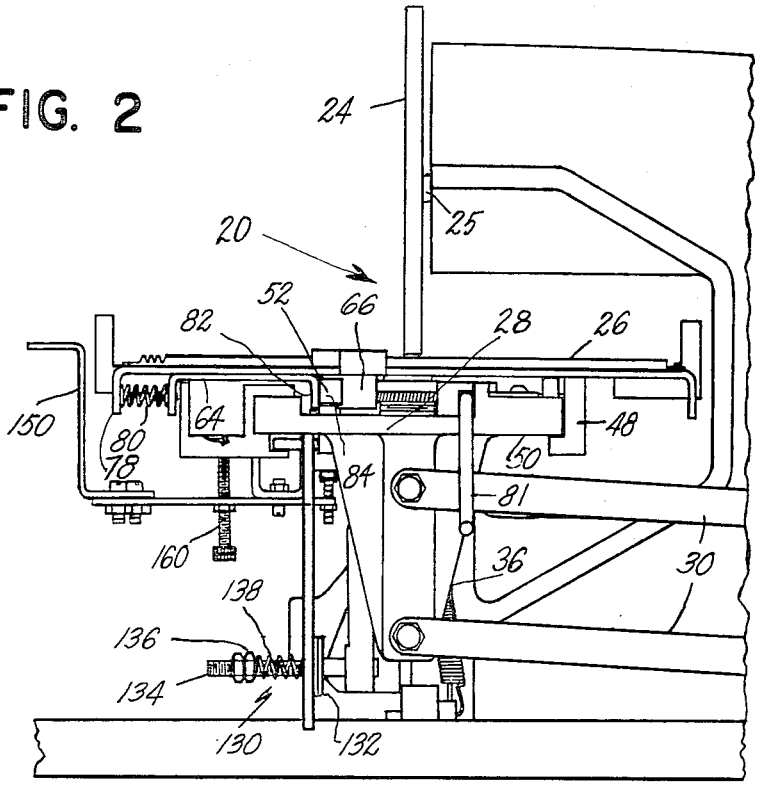
FIG. 2, is a view in side elevation taken from the right side.
Figure 1:
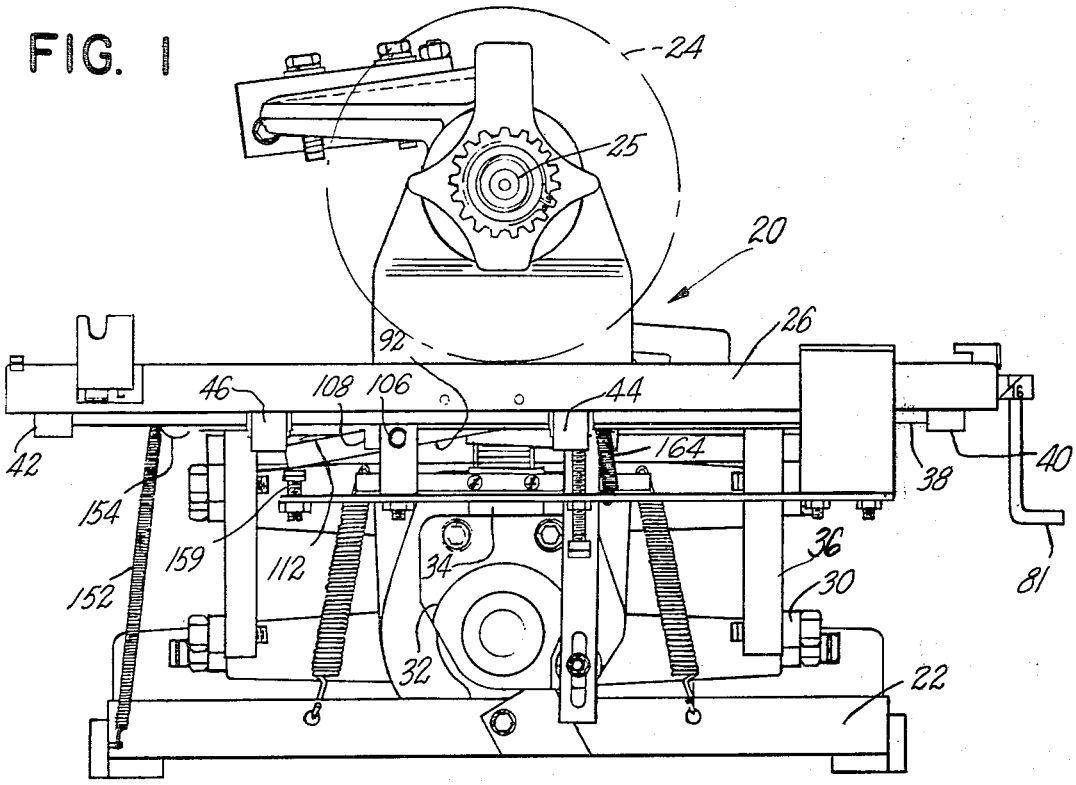
FIG. 1, is a view in front elevation of the machine.
Figure 3:
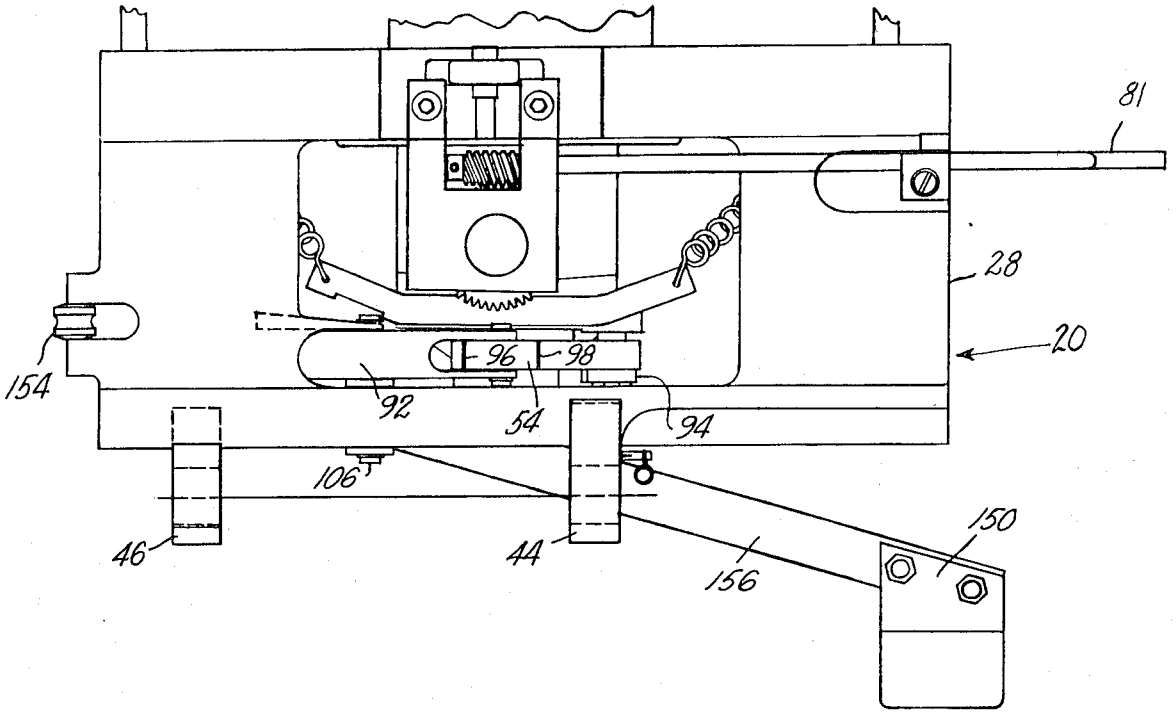
FIG. 3, is a top plan view.

The marking machine of this invention is generally indicated by the reference numeral 20 in FIGS. 1, 2 and 3. It is comprised of a base 22, a motor not shown, a printing wheel 24, a work table 26 and a key-board, not shown, for operation of the machine.

The printing wheel 24, as well as the work table and key-board are the same general construction as described in my U.S. Pat. Nos. 2,664,985 and 3,785,470. Thus the printing wheel 24 has printing characters on its periphery and is driven by a shaft 25 connected to a ratchet wheel and to the motor through a friction clutch and is driven by a pulley belt. A magnetically operated pawl is adjusted to engage the teeth of a ratchet wheel and stop the wheel against the force of the friction clutch.

The work table 26 is supported upon a carriage casting 28 and is pivotably supported on the machine by a yoke and pivot bar connection 30. The carriage casting is raised and lowered by the revolution of a rotary cam 32 which contacts a thrust bar 34 at the bottom of the carriage casting which supports the table. The cam is connected to a camshaft which is driven only one revolution in a single marking operation by means of a clutch connected to the motor and which is actuated by a clutch actuator. Appropriate circuitry is provided between the key-board and the various components to effect the operation of the marking wheel and the camshaft as fully described in my afore-mentioned patents. The afore-mentioned components are fully described therein and form no part of the instant invention, per se.

The work table 26 is supported upon a carriage casting 28 as best shown in FIGS. 1, 2 and 3. The carriage casting is more particularly shown in FIGS. 17 through 20. The general relationship of the carriage casting and the work table is similar to that shown in my afore-mentioned U.S. Patents. Thus the carriage casting is moved up and down responsive to movement of the rotary cam 32 and makes a single revolution in a marking operation. The downward movement is facilitated by biasing springs 33 connecting the carriage casting to the base 22. The work table which is supported upon the carriage casting and moves with it, is also disengaged for transverse movement so as to advance a work tag or the like which is held upon it for further marking operations. A support of the carriage casting for the vertical movement is provided by a pair of yoke members 36 which are pivotably connected to the pivot bar members 30.

The transverse movement of the work table which is provided by the feed pawl and rack mechanism of this invention, to be fully described herein below, is generally accomplished by sliding movement upon a guide rod 38 which is supported beneath the work table by bearing blocks 40 and 42. The guide rod is journalled upon the carriage casting by journals 44 and 46. Each of the journals contains a linear ball bearing member 47 to minimize friction between the guide rod and the bearing members and facilitate with a minimum of friction transverse movement of the work table with respect to the carriage casting. Underneath the rear portion of the work table are hold-down blocks 48 which are L-shaped in configuration and bear underneath a rear portion 50 of the carriage casting for relative sliding movement between the two.

Figure 10:
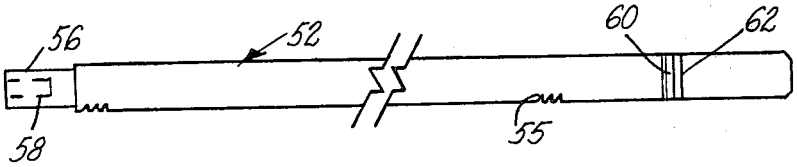
FIG. 10, is a view in front elevation of the feed rack.

In order to provide for advancement of the work table in the transverse movement and spacing for each marking operation the feed rack and pawl mechanism is utilized. A feed rack or feed bar 52 is supported underneath the work table and is used in conjunction with a feed pawl 54. The feed rack 52 is best shown in FIGS. 2 and 10. It is of a polygonal cross-section, typically for example a square cross-section, having a series of equally spaced teeth on each side. The teeth may have a different spacing on the sides to provide for different spacing on the work table of the tag or nameplate which is to be marked. The feed rack may be rotated to present the different sides to the feed pawl for different spacing operations. The feed bar 52, as shown in FIG. 10 is comprised of a series of equally spaced teeth 55 at the bottom side which are adapted to be engaged by the teeth of the feed pawl as will be more fully described.

It will be further understood that in addition to the bottom side the other three sides of the feed bar may be provided with teeth of different spacing to provide for different spacing increments of the work table as it is moved in each marking operation.

The left end of the feed bar is of a circular cross-section at the end portion 56. This circular end portion or cylindrical end portion, is journalled underneath the work table. A tapped hole 58 is provided which may receive a bolt or the like and a washer for retention in the bearing 59 while permitting rotational movement.

Figure 11:
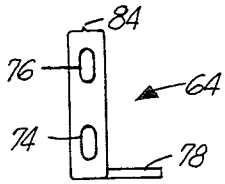
FIG. 11, is a top plan view of the half-tooth lock pawl.
Figure 12:
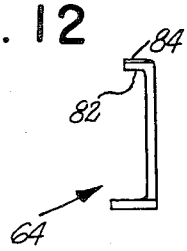
FIG. 12, is a view in side elevation of the half-tooth lock pawl taken from the left side.
Figure 13:
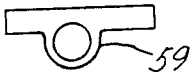
FIG. 13, is a view in front elevation of the feed rack bearing block for the left end of the rack.
Figure 15:
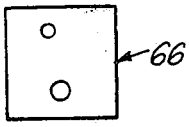
FIG. 15, is a top plan view of the right end feed rack bearing block.
Figure 14:
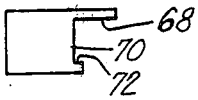
FIG. 14, is a view in left side elevation of the feed rack bearing block for the right end of the rack.
Figure 16:
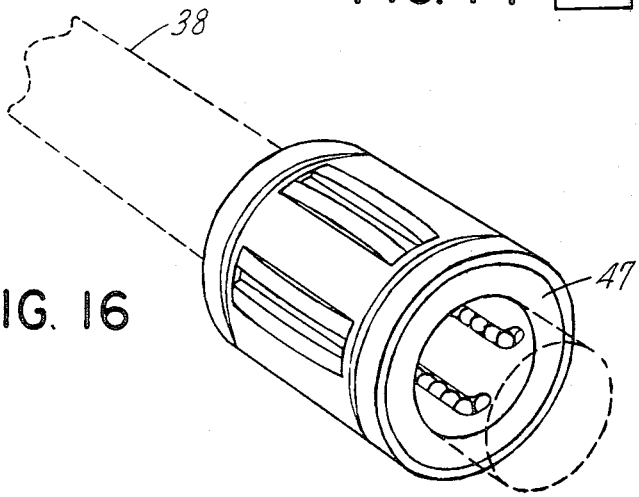
FIG. 16, is a pictorial view of a linear ball bearing assembly for the carriage guide rod.
Figure 17:
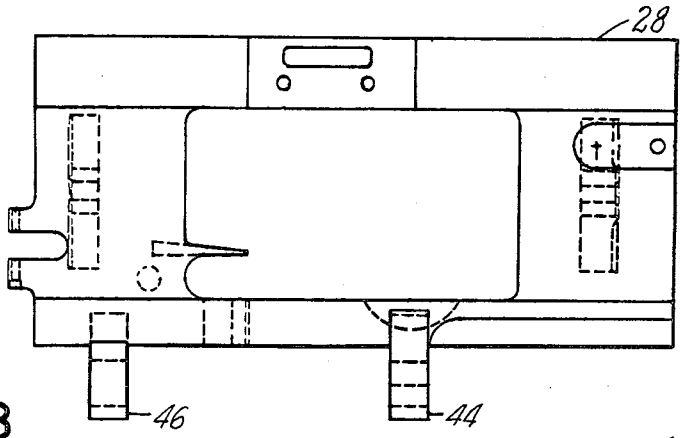
FIG. 17, is a top plan view of the carriage casting.
Figure 18:
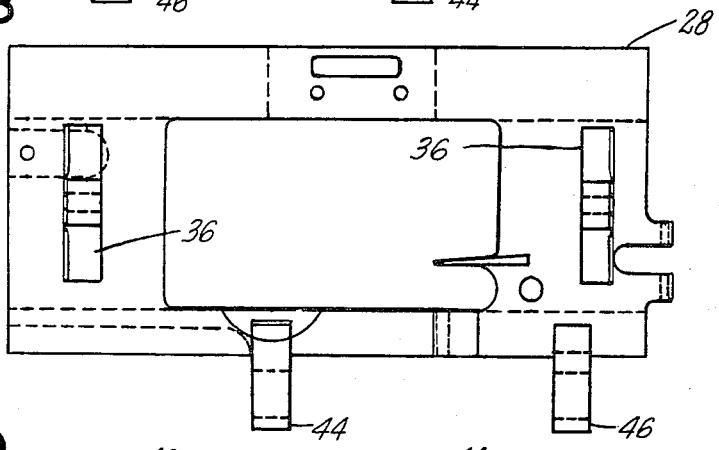
FIG. 18, is a bottom plan view of the carriage casting.
Figure 19:
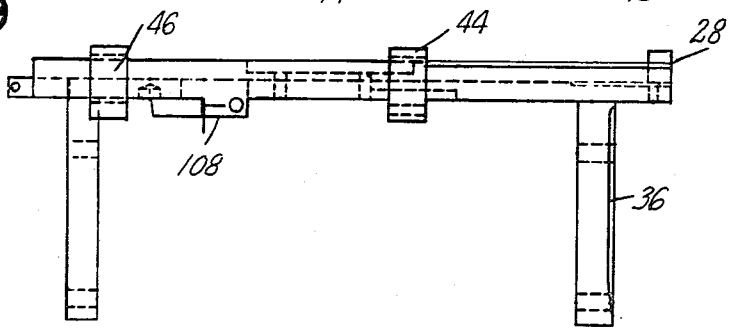
FIG. 19, is a front elevational view of the carriage casting.
Figure 20:
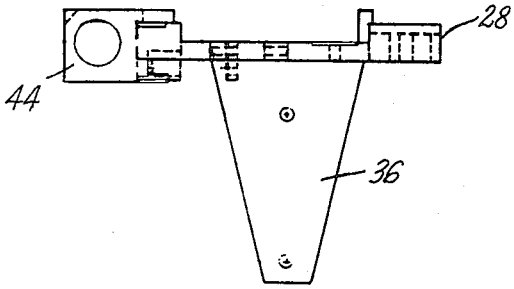
FIG. 20, is a right side elevational view of the carriage casting.

The right end of the bar as shown in FIG. 10 is provided with a pair of half-teeth or notches 60 and 52 acting as a detent means. These notches are situated apart half the distance between the spacing of the teeth 55. The notches are adapted to be engaged by a half-tooth lock pawl 64 as best shown in FIGS. 11 and 12 by axial movement of the rack one half tooth distance. In this manner the work table may be manually moved the distance of one-half tooth to vary the spacing for a particular marking operation as desired.

The feed rack is supported at the right end underneath the work table by bearing block 66. The bearing block as best shown in FIG. 2 is supported underneath the work table and is comprised of sides 68 and 70 which are co-extensive and co-terminous with the sides of the feed rack. A lip 72 is located underneath the feed rack and permits the polygonal end portion of the feed bar, which in the drawings is shown as a squared cross-section, to be rotated against the biasing action of the half-tooth lock pawl.

The half-tooth lock pawl 64 as best shown in FIGS. 2, 11 and 12 has a pair of slots 74 and 76 which receive loosely a connecting bolt underneath the work table and a guide pin so that the pawl may be loosely held for sliding movement underneath the work table. A handle member 78 extends to one side and biasing spring 80 urges the half-tooth lock pawl against the feed rack. A flange member 82 if formed in one end of the half-tooth lock pawl which is biased toward the feed rack and is provided with a tooth element 84 which engages one of the two notches 60 and 62 which defined the half-tooth spacing means on the feed rack. When the feed rack is desired to be moved a half-tooth distance for a half-spacing movement the half-tooth lock pawl is simply drawn back slightly and the feed rack is moved either from the notch 60 to the notch 62 or, vice-versa, as desired.

Figure 4:
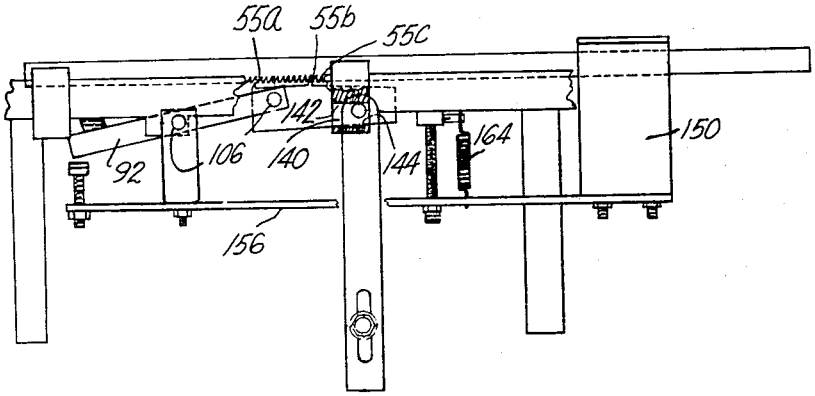
FIG. 4, is a fragmentary view in front elevation with part of the work table removed showing the feed pawl and rack mechanism and the work table in the rest position.
Figure 5:
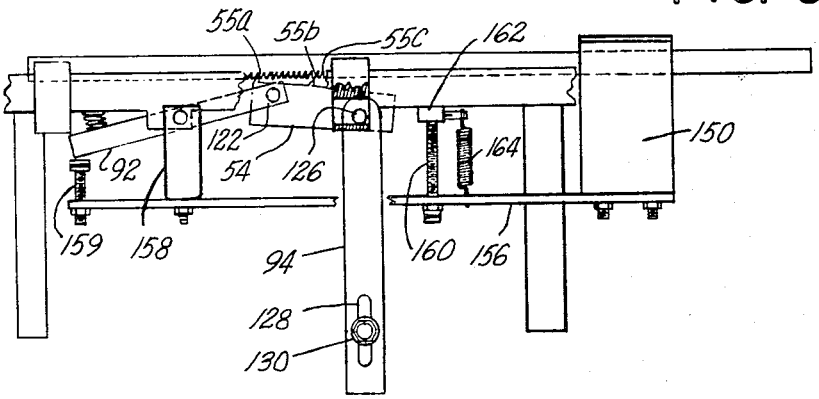
FIG. 5, is a view similar to FIG. 4, but showing the work table in the elevated and marking position.
Figure 6:
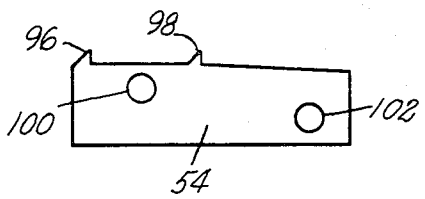
FIG. 6, is a view in front elevation of the feed pawl.

The feed pawl advancing mechanism is best shown in FIGS. 1, 4 and 5 for the assembly mechanism. The feed pawl shown in FIGS. 4 and 5, which is pivotally supported at the left end by a feed pawl link 92 and at the right end by a feed pawl drag link 94. The feed pawl is comprised of left end tooth 96 and a right end tooth 98 which are engageable with selected teeth of the feed rack. In the preferred operation the spacing of the teeth 96 and 98 may for purpose of example be 0.765 inches while the spacing of the teeth on the feed rack with which the teeth of the feed pawl are engageable is 0.750 inches. The difference in the spacing enables the teeth of the feed pawl to walk so to speak or bear against the teeth on the feed rack in the advancing operation. It will be understood however, that by the simple reversal of the operation of the feed pawl advancing mechanism the distance between the teeth of the feed pawl link instead of being slightly greater than the respective distance of the teeth of the feed rack may be slightly less. The spacing between the teeth on the feed rack is in multiples which are divisible by 0.750 in order to obtain the proper relationship with a single feed pawl.

The feed pawl is further provided with holes 100 and 102 which receive pins connecting the pawl to the feed pawl link and the drag link, respectively.

Figure 7:
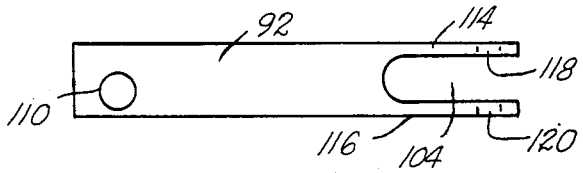
FIG. 7, is a top plan view of the feed pawl link.
Figure 8:
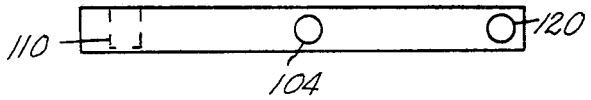
FIG. 8, is a view in front elevation of the feed pawl link.

The feed pawl link 92 is best shown in FIGS. 1, 7 and 8. It is provided with a central opening 104 which receives a pin. The pin designated by the reference numeral 106 is journalled within a boss 108 on the carriage casting. The feed pawl link 92 is further provided with a cup-shaped recessed seat 110 which receives a spring 112 which at its other end is seated within a cup-shaped recess in the underneath side of the carriage casting. The right end portion of the feed link is bifurcated and has a pair of tongue members 114 and 116 which are provided with holes 118 and 120, respectively. These holes receive a pin 122 connecting the feed link with the hole 100 in the feed pawl.

Figure 9:
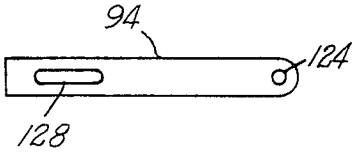
FIG. 9, is a view in front elevation of the feed drag link.

The drag link is best shown in FIGS. 1 and 9. The drag link 94 is provided with a hole 124 which receives pin 126 connecting it to the feed pawl hole 102. The bottom end of the drag link is provided with an elongated slot 128 which receives a friction clutch connection generally designated by the reference numeral 130. This friction clutch assembly is provided by a friction pad 132 at the back of the drag link and which receives a bolt 134 connected to frame of the machine to provide a stationary support. The bolt 134 has an adjustment nut 136 with a biasing spring 138 so that pressure may be brought against the drag link to restrain it against the force of the spring 112 acting on the feed pawl link. At the same time reciprocatory movement of the drag link may be effected through this friction clutch mechanism where oversize tags are employed and also provide for self-adjusting relationship within limiting guide slots provided in the carriage casting as will be further described.

The feed pawl mechanism as best shown in FIGS. 4 and 5 further includes a guide slot provision in the carriage casting. This is accomplished by a groove or slot 140 having an upper side 142 and a lower side 144. This defines a limiting movement for the pin 126 which connects the feed pawl link with the drag link and limits the movement of the feed pawl upwardly and downwardly.

A carriage release button or lever 150 is provided to disengage the feed pawl from the feed rack. When so disengaged a biasing spring 152 connected at one end to the machine frame and at the other over a roller 154 to the work table urges the work table to the left in order that the work table may be moved all the way to the left or manually moved to any desired transverse position to provide for proper positioning of nameplates, tags or the like which is to be marked. The carriage release button 150 is best shown in FIGS. 1, 2, 4 and 5. The release button 150 is connected to a release shaft 156 which is pivotally supported by a yoke 158 pivotally supported by pin 106. At the left end an adjustment bolt or contact member 159 is adjusted so that it is normally just a few thousands of an inch out of engagement with the feed link during the normal operation of the mechanism. A further adjustment bolt 160 is provided at the right end of the shaft and is biased against a bearing block 162 underneath the carriage casting by a biasing spring 164. When the carriage release is desired to be operated the button is pressed downwardly to move the adjustment bolt 159 slightly upwardly to engage the feed pawl link and rotate it clockwise as viewed in FIG. 4. This causes the disengagement of both teeth of the feed pawl with the feed rack and enables the work table to be moved manually to a desired position or by the force of the biasing spring 152 to move all the way to the left on the carriage casting by sliding movement on the carriage guide rod 38.

Operation

The operation of this machine is conventional for this type of operation of machine where the rotary marking wheel is continuously rotated until a keyboard character is operated. At this point the desired symbol corresponding to a letter or numeral is stopped at the marking position directly overlying the work table. The ratchet mechanism is operated to cause it to stop while at the same time the camshaft clutch actuating mechanism is engaged to connect the camshaft and cause it to drive one single revolution per operation of the keyboard. The rotation of the camshaft 32 causes the work table to be raised and lowered one full cycle and perform the marking operation. Pressure is applied between the marking wheel and the work piece be it a tag or a nameplate or the like held by the work table to perform this marking operation. In this marking operation the sequence of engagement and disengagement of the feed pawl linkage with the feed rack will be described below.

In the rest position, the work table is lowered and the relationship of the feed pawl 54 and associated linkage and feed rack 52 is shown in FIG. 4. In this position a feed rack tooth bears against the right hand tooth 98 of the feed pawl 54 in biased relation by the force of the work table biasing spring 152. The left hand tooth 96 of the feed pawl is spaced slightly to the left of a tooth **55*a* of the feed rack next to it on the right hand side. The limit pin 126 connecting the feed pawl with the top of the drag link 94 by the action of a previous operation may be driven slightly downwardly and may bear against the top side 142 of the limit slot 140 in the carriage casting as shown. The engagement of the right hand tooth 98 of the feed pawl with the tooth 55*b* of the feed rack is accomplished by the force of the biasing spring 112 acting on the left hand end of the feed pawl link 92**.

When a marking operation is commenced, the camshaft or eccentric 32 rotates one full revolution to raise and lower the table 26 while the marking wheel 24 is stopped and with the upward work table movement the marking is effected. At the beginning of this table raising operation the eccentric as it rotates causes the bearing or thrust block 34 connected to the underside of the carriage to move upwardly. At the beginning of the upward movement of the carriage the top side 142 of the guide slot moves out of contact with the limit pin 126 connecting the feed pawl to the drag link. The force of the biasing spring 112 acting on the left hand of the feed link 92 causes the feed pawl to move a slight degree clockwise about the limit pin 126 moving the right hand tooth 98 of the feed pawl out of engagement with the rack while moving the left hand pawl tooth 96 slightly upwardly. The table by the force of the biasing spring 152 then moves the feed rack tooth **55*a*** into engagement with the left hand tooth of the feed pawl by a very slight degree of movement. The work table and carriage continue to rise to the top of the stroke. When the top of the stroke is reached by tag or other material to be marked is held in conventional fashion upon the work table and is marked by the marking wheel which by magnetic clutch actuation stops at this precise point and the printing of the selected character is effected.

After the marking operation at the top of the stroke the work table begins to be lowered by the biasing action of springs 33 acting on the carriage and the continued rotation of the eccentric. As the table moves downwardly the feed pawl link 92 is caused to move a slight degree of movement clockwise and the feed pawl 54 moves then a slight degree counterclockwise. When this movement is effected the left hand tooth 96 of the feed pawl is moved out of engagement with the feed rack and at this precise moment the right hand tooth of the feed pawl is moved into the gap between the tooth 55*b* and the next adjacent teeth 55*c* of the feed rack. The table moves to the left by the force of the work table biasing spring and is caught by the next adjacent tooth 55*c* to the right of the tooth 55*b* bearing against the right hand tooth of the feed pawl. The table is then lowered to the rest position to await the next marking operation. In the afore-mentioned operation the table is adjustable for different heights by a conventional carriage lever 81.

The drag link 94 through its friction clutch 130 accommodates different thicknesses of work tags or the like to be marked. Thus the movement of the clutch within the vertical slot 128 of the lower portion of the drag link accommodates such different thicknesses. The drag link is self-adjusting for the different thicknesses of work tags to be marked by the simple operation of a conventional spacer bar on the keyboard which automatically sets up the drag link and its limited motion within the guide slot for the next marking operation.

In the afore-mentioned operation of the work table and the feed pawl and feed rack mechanism and drive components the movement of the work table and carriage to the upper and lower limit positions is slightly greater than the depth of the guide slot 140 in the carriage which limits the upward and downward movement of the connecting limit pin 126 which connects the feed pawl 54 and the drag link 94. This causes the drag link 94 to move slightly in the upper and lower positions which movement is accommodated by the friction clutch connecting it at the bottom. The friction clutch 130 is simply adjusted to provide the afore-mentioned movement yet at the same time is sufficiently strong to hold against the force of the biasing spring 112 acting on the left end of feed pawl link or lever.

When it is desired to move the work piece carried by the work table a half-space this operation is simply effected. The half-tooth lock pawl 64 is simply engaged by the handle 78 to move it slightly backwardly and the feed rack is then moved from either engagement with notch 60 or 62, or vice-verse, as desired. The feed pawl mechanism will then operate as previously described but a half-space off in relation to previous marking. It will be understood that the feed rack may be changed a half-tooth distance with respect to the work table for a single marking operation and reset or for all subsequent marking as desired by the operator.

Further the feed rack may be simply rotated to present an entirely different spacing of characters. Each side of the square shaped feed rack may be provided with differently spaced characters so that the operator can choose the proper spacing by simply selecting any of the four sides. It will be understood that a polygonal relationship may be used for the shaft such that it may be either triangular, square shaped as shown, hexagonal and the like as desired by simply changing the bearing block relationship as necessary and as will be obvious to those skilled in the art.

The carriage release operation is simply effected by merely depressing the carriage release button or handle 150. This operation causes the shaft 156 to rotate clockwise a slight degree to contact the contact bolt 159 with the underneath side of the feed pawl link 92 as best shown in FIGS. 4 and 5. This contact against the force of the biasing spring 112 causes the feed pawl to move slightly downwardly as the feed pawl link rotates a slight degree clockwise and disengage both of the feed pawl teeth with the feed rack. The work table is then unlocked and acts with the biasing spring 152 to move to the left unless restrained by the operator to be moved to any desired transverse position. When pressure is released from the carriage release button 150 the locking relationship is re-established as shown in FIG. 4 to the rest position.

The marking machine of this invention with the improved advancing feed pawl and rack mechanism is very adaptable with respect to trouble-free operation and accommodating different thicknesses of nameplates, plastic tags or the like to be marked. The machine is simply operated and maintained and is rugged in its operation. By means of the improved half-spacing adjustment and selective teeth for different spacings the marking spacing may be varied for selected operations.

Various changes and modifications may be made within this invention as will be readily apparent to those skilled in the art. Such changes and modifications are within the scope of teaching of this invention as defined by the claims appended hereto.

What is claimed is:

1. In a marking machine having a vertically moveable carriage supporting a transversely moveable work table supporting a workpiece to be marked by marking characters, said table being transversely moveable with respect to said carriage to advance the workpiece as it is being marked, table advancing means comprising a toothed rack having a series of teeth equi-distantly spaced along a side of the rack and pawl means engageable with said rack for advancing the table the distance between adjacent teeth for each marking operation, the improvement comprising said pawl means including a feed pawl having a pair of teeth engageable with the teeth in said rack, said pawl being pivoted at one end to a feed link member operable to pivot one end of the pawl and pivoted at a second end to a drag member operable to pivot a second end of the feed pawl about a moveable pivot member, limit guide means on said carriage defining upper and lower stops for said pivot member as the carriage is raised and lowered and friction clutch means on said drag member permitting the drag member to move responsive to contact of the limit guide means with the moveable pivot member.

2. The marking machine of claim 1, in which said feed link member is biased by a biasing means to urge the pawl into engagement with said rack.

3. The marking machine of claim 2, in which said friction clutch is operable to exceed the force of said biasing means and yield to contact by said limit guide means.

4. The marking machine of claim 2, in which a work table release is provided, said release comprising a pivotable operating shaft having a contact member engageable with said feed link member to pivot the feed pawl out of engagement with the feed rack and means biasing the operating shaft to hold said contact member out of engagement with said feed link member until said operating shaft is manually engaged, said contact member being engageable with said feed link member to overcome the force of said biasing means.

5. The marking machine of claim 4, in which the operating shaft is provided with an adjustable stop member limiting the movement of said shaft against the means biasing the operating shaft.

6. The marking machine of claim 1, in which said drag member is pivotally connected to a stationary part of the machine and said friction clutch means is adjustably engageable with said last named pivot connection.

7. The marking machine of claim 6, in which said last named pivot connection comprises a stationary pivot pin engageable in slot provided in said drag member and said friction clutch means comprising adjustable engaging elements for slidably fastening the drag member to the pivot pin.

8. The marking machine of claim 1, in which the drag member is pivotally connected to the pawl by a pivot pin having an extension element and said guide means comprises a slot in the carriage receiving said extension element and having upper and lower side walls limiting vertical movement of said extension element.

9. The marking machine of claim 1, in which the feed link member is pivoted to the pawl at a pivot point fixed to said carriage and the drag member is pivoted to the pawl at a pivot point freely moveable with respect to said carriage subject to engagement by said limit guide means.

10. The marking machine of claim 9, in which a work table release is provided, said release comprising a pivotable operating shaft having a contact member engageable with said feed link member to pivot the feed pawl out of engagement with the feed rack and means biasing the operating shaft to hold said contact member out of engagement with said feed link member until said operating shaft is manually engaged, said operating shaft being pivotable on a pivot pin connected to said carriage and forming the pivot connection for said feed link member.

11. The marking machine of claim 1, in which a work table release is provided, said release comprising a pivotable operating shaft having a contact member engageable with said feed link member to pivot the feed pawl out of engagement with the feed rack and means biasing the operating shaft to hold said contact member out of engagement with said feed link member until said operating shaft is manually engaged.

12. The marking machine of claim 1, in which the carriage is provided with a transversely extending guide shaft supporting said work table for transverse movement thereon, said work table having linear ball bearing means circumferentially girdling a portion of said shaft to provide for low friction sliding movement of said work table as it is advanced.

* * * * *